United States Patent [19]

Lemmon

[11] Patent Number: 4,620,747

[45] Date of Patent: Nov. 4, 1986

[54] CUSTOM CONSTRUCTION SYSTEM

[76] Inventor: Patrick Lemmon, 1323 Delta Ave., Cincinnati, Ohio 45208

[21] Appl. No.: 535,279

[22] Filed: Sep. 23, 1983

[51] Int. Cl.[4] ..... A47B 3/00

[52] U.S. Cl. ..... 297/440; 52/633; 108/111; 403/169; 446/123

[58] Field of Search ..... 52/633, 585, 645, 646, 52/648; 297/440, 445; 403/169; 108/111; 446/479, 482, 102, 108, 109, 111, 123, 129

[56] References Cited

U.S. PATENT DOCUMENTS

| | | | |
|---|---|---|---|
| 1,701,190 | 2/1929 | Paulson | 446/123 |
| 2,426,326 | 8/1947 | Tooms | 446/102 |
| 3,193,060 | 7/1965 | Park | 52/633 X |
| 3,355,837 | 12/1967 | Pedersen | 446/123 |
| 3,426,418 | 2/1969 | Maloney | 33/197 X |

FOREIGN PATENT DOCUMENTS

| | | | |
|---|---|---|---|
| 572585 | 2/1924 | France | 446/102 |
| 2405730 | 6/1979 | France | 446/108 |

*Primary Examiner*—James T. McCall

[57] ABSTRACT

A Custom Construction System consisting of a novel structural member in combination with as required, spreader members and equalizer members which are assembled together by various nuts, bolts and other hardware to produce various pieces of furniture and other home improvement projects. The basic structural member consists of a rectangular shaped member having rounded edges and a plurality of bores passing through both its wider and narrower surfaces. The basic structural member and the spreader members can be constructed utilizing a template. The template consists of piece of material having two flanges at approximately a 90° angle with respect to each other. One of the flanges has a rounded end. Both flanges have bores located on their surfaces which are used for marking the location of the bores on workpieces to be converted into structural members and spreader members.

4 Claims, 29 Drawing Figures

CUSTOM CONSTRUCTION SYSTEM

BACKGROUND OF THE INVENTION

1. Field of the Invention

The present invention relates to a Custom Construction System which utilizes basic construction components to produce a wide variety of furniture and home improvement projects.

2. Description of the Prior Art

It is known in the prior art to utilize various structural pieces to construct furniture. As disclosed in U.S. Pat. No. 3,101,061 (Amend) a piece of furniture is readily conveted from a picnic table to a work bench and back to a picnic table. Additionally, U.S. Pat. No. 3,706,473 (Mullen) discloses a structural modular furniture construction using preformed blocks of resilient or less elastomeric material having rounded edges with openings for connecting the blocks to form structural furniture assemblies used the construction of reclining furniture pieces.

While these prior art devices disclose the general concept of utilizing interchangeable components having apertures to produce various pieces of furniture, they are applicable only, at most, to one or two specific pieces of furniture.

In constrast, the present invention greatly increases the number of pieces of furntirue which can be constructed utilizing basic structural members, and if needed, spreader members, and equalizer members. While retaining the flexibility to create a wide variety of furntiure pieces, the present invention allows "home-do-it-yourself" carpenters to construct a wide variety of strong, stylish furniture pieces for use on the patio or deck, in the backyard, in the work shop and laundry room, in the bedroom, in the kitchen and in the family room.

In addition to the above stated versatility of the present invention, applicant has taken the aforementioned basic components assembled with simple hardware such as carriage bolts, hex nuts, flat washers and some special hardware such as rotating joint and parallel joint braces, gang nail washers and bolt end caps to produce furniture for the aforementioned area of the home. Thus the present invention provides "home-do-it-yourself" carpenters with the ability to construct simple, strong, stylish and beautiful furniture utilizing only his two hands and a one half inch wrench.

SUMMARY OF THE INVENTION

The present invention relates to a highly versatile Custom Construction System utilizing, in combination with the novel structural members, as required, spreader members, and equalizer members assembled by various nuts, bolts and other hardware.

The key component of the present invention consists of a rectangular shaped structural member having rounded edges and a plurality of bores passing through both its wider and narrower surfaces. This basic structural member is then utilized in connection with, as may be required, spreader members and/or equalizer members to construct the various pieces of furniture and to accomplish a wide variety of home improvement projects.

A further component of the present invention consists of a means for constructing structural members and spreader members utilized in the Custom Construction System. The means for constructing a template consists of a piece of material, having two flanges at approximately a 90° angle, with respect to each other one flange having a rounded end. Both flanges have bores located on the surface thereof for marking the location of the bores on workpieces to be converted into structural members and spreader members.

Accordingly, it is an object of the present invention to provide a Custom Construction System which can be utilized by unskilled "home-do-it-yourself" carpenters to construct a large variety of furniture pieces.

It is another object of the present invention to provide a Custom Construction System which utilizes structural members in combination with, as required, spreader members and/or equalizer members, thereby creating a strong durable wood-bond in pieces of furniture.

It is yet another object of the present invention to provide a Custom Construction System having structural members which when assembled into pieces of furniture provides a unique designer look.

It is still another object of the present invention to provide a Custom Construction System having structural members which are exceptional purchase values to the "home-do-it-yourself" carpenters in accomplishing projects around the home.

It is still another object of the present invention to provide a Custom Construction System having structural members which can be adapted to build pieces of furniture for the deck, the back-yard, the workshop, the laundry room, the bedroom, the kitchen, the family room or any imaginable project.

It is still another object of the present invention to provide a Custom Construction System having structural members that are simple for "home-do-it-yourself" carpenters to use.

It is still another object of the present invention to provide a device which will enable "home-do-it-yourself" carpenters to construct their own structural members to build various pieces of furniture.

It is still another object of the present invention to provide a structural member for use with the Custom Construction System which provides non-rotating wood-to-wood joints.

It is still a further object of the present invention to provide a structural member for use with the Custom Construction System which provides rotating wood-to-wood joints.

It is a further object of the present invention to provide a Custom Construction System having a structural member which when utilized to build furniture requires a minimum amount of tools.

It is yet another object of the present invention to provide a Custom Construction System having structural members which enables the unskilled "home-do-it-yourself" carpenters to construct a multitude of furniture pieces.

Further objects and advantages of the present invention will become apparent from the following description of the preferred embodiment, the claims and the attached drawings.

BRIEF DESCRIPTION OF THE DRAWINGS

In the following detailed description of the preferred embodiment of the present invention, reference is made to the accompanying drawings, in which.

DETAILED DESCRIPTION OF THE PREFERRED EMBODIMENT

The following description will be directed in particular to elements performing part of or cooperating more directly with the present invention. Elements not specifically shown or described herein are understood and selected from those known in the art.

Figure 1:
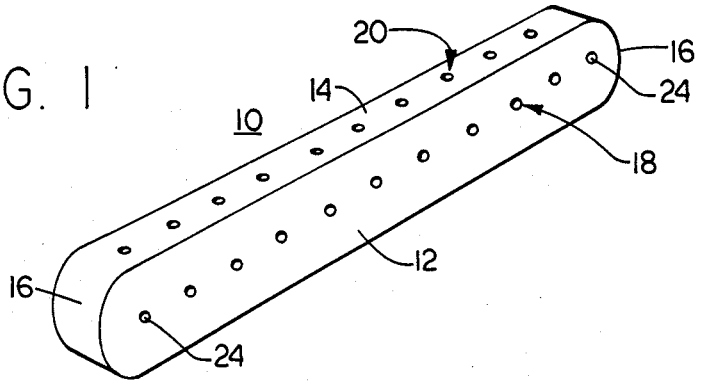
FIG. 1 is a perspective view of the preferred embodiment of the structural member utilized in the Custom Construction System.
Figure 2:
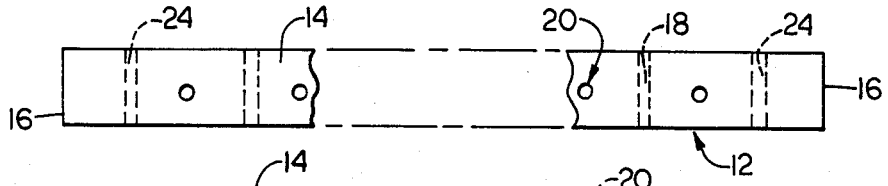
FIG. 2 is a top or bottom view of the structural member illustrating the relationship between the bores through each side and edge of the structural member of FIG. 1.
Figure 3:
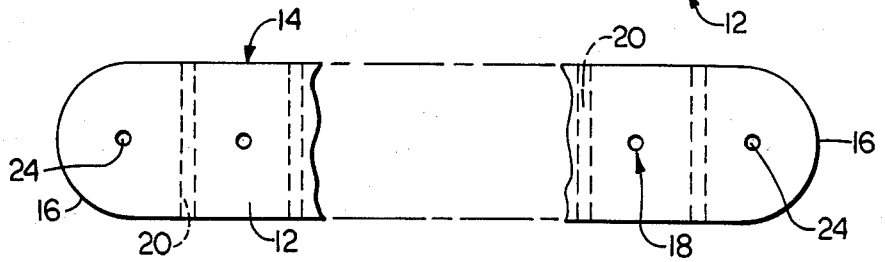
FIG. 3 is a side fragmentary view also illustrating the relationship between the bores through the respective edges and sides of the structural member of FIG. 1.

Referring now to the drawings and specifically to FIGS. 1-3, means are provided for constructing a wide variety of furniture pieces and home improvement projects. In the embodiment illustrated, this consists of structural member 10 utilized in accordance with the present invention, the Custom Construction System. Structural member 10 consists of the following major elements: side surfaces 12, edges 14, rounded ends 16, side surface bores 18, and edge bores 20. Structural member 10 is preferably produced by performing modifications to the basic 2"×4" piece of lumber.

The distance across side surface 12 is the width of member 10 while the distance across edges 14 is the thickness thereof. Side surface bores 18 are clear bores that pass through the thickness of member 10 and reside along the centerline of side surface 12, and are equally spaced. In similar manner, edge bores 20 are clear bores that pass through the width of member 10 and reside on the centerline of edges 14, and are equally spaced at the same intervals as the side bores 18. There are two more bores in the set of side bores 18 than there are in the set of edge bores 20. As best illustrated in FIGS. 2 and 3, edge bores 20 are located alternately with respect to side surface bores 18.

It is important to the present invention to note that member 10 is not a single sized or length member but may be any one in a series of different sized or length members that forms the central elements of the Custom Construction System for constructing furniture and the like. As stated, members 10 differ only in their length and the number of side surface bores 18 and edge bores 20 all other features remain the same. Lengths may be determined by the number of side bores in each member. The Custom Construction System preferably utilizes member 10 with side surface bores 18 numbering: 3, 4, 5, 7, 9, 10, 11, 13, 15, 17, 21, 25, or 31 with each side surface bore 18 being spaced three inches apart.

Means are provided for eliminating sharp or jagged edges. In the embodiment illustrated in FIGS. 4 and 5, this consists of rounded end 16 of member 10. Rounded end 16 is formed by swinging a radius 22 that is equal to one half the width of member 10, about end bore 24 of side surface bore 18. In this manner, each member 10 exhibits a full semicircular end.

Figure 4:
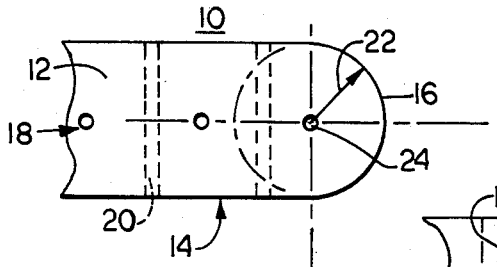
FIG. 4 is a fragmentary side view illustrating the formation of the rounded ends of the structural member as illustrated in FIG. 1.
Figure 6:
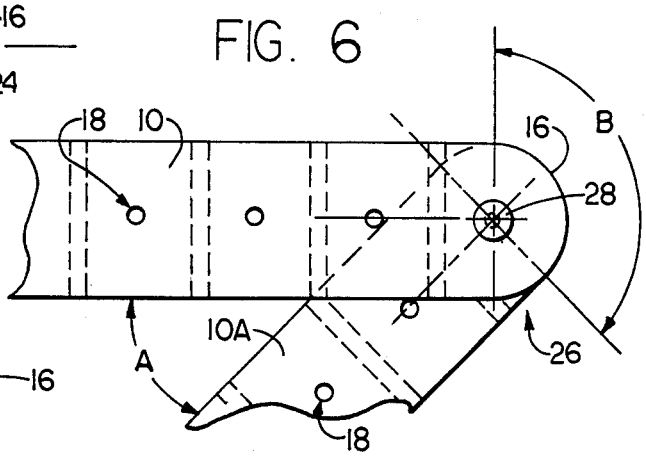
FIG. 6 is a fragmentary view of the joint between two structural members of FIG. 1 illustrating the circular arc produced by the joint.
Figure 5:
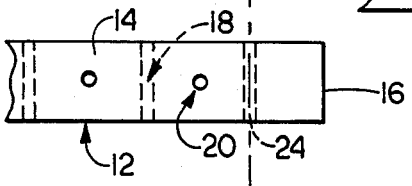
FIG. 5 is a fragmentary top or bottom view illustrating the formation of the rounding of the rounded ends of the structural member of FIG. 1 as viewed from the narrow edge or top or bottom view as illustrated in FIG. 2.
Figure 7:
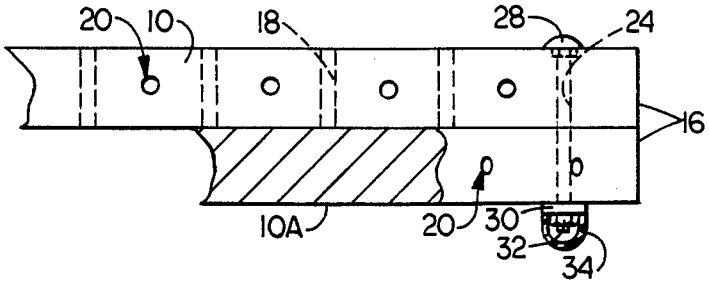
FIG. 7 is a fragmentary top or bottom view of the joint of FIG. 6 illustrating the method of forming the joint of two structural members of FIG. 1.

Referring now to FIGS. 6 and 7, the end construction, resulting from that illustrated in FIGS. 4 and 5 mentioned above, is a full semicircular end having no sharp corners. Thus, the formation of end overlap joint 26 will always produce a circular arc exposure "B" no matter what angle "A" of the joint might be. Since no sharp corners are in evidence, typically, the two members 10 and 10A are operatively connected to each other by carriage bolt 28, washer 30, and nut 32. Carriage bolt 28 passes through end bores 24 of each member 10 and 10A to receive washer 30 and to threadably receive nut 32. Soft cap 34 is frictionally attached over nut 32 to enclose the end of carriage bolt 28. Additionally, side bores 18 and edge bores 20 would be counter sunk to prevent the top of carriage bolt 28 from protruding above the side or edge surface of members 10.

It should be pointed out that joints other than the overlapping joint 26 of FIGS. 6 and 7 can be formed with members 10 and 10A. Bolt 28 can pass through any of the side surface bores 18 in members 10 and 10A to form an overlapping cross joint or end joint. Additionally, a bolt somewhat longer than bolt 28 can pass through one side surface bore 18 in one structural memeber 10 and then through one edge bore 20 of another structural member 10A to form an edge wise cross joint.

Figure 8:
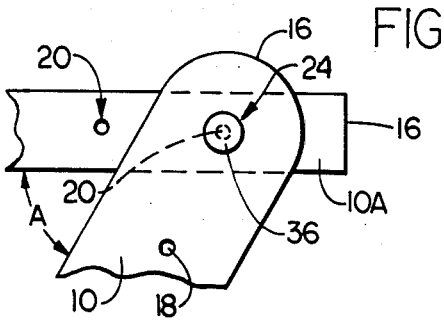
FIG. 8 is a fragmentary side view illustrating a special edgewise cross joint of the side of the structural member of FIG. 1 with the edge of another structural member of FIG. 1.

As best illustrated in FIG. 8, a special edgewise cross joint is depicted. Carriage bolt 36 is passed through end bore 24 of side surface bores 18 of member 10 and then through any edge bore 20 of member 10A. In this particular end joint, since no sharp corners are present, rounded end 16 of member 10 partially extends beyond, but not obtrusively beyond, member 10A.

As best illustrated in FIGS. 6 and 7, means are provided for producing a joint that exhibits a moderate torque resistance. In the embodiment illustrated, this consists of nut 32 hich is tightened to cause the overlapping areas of member 10 and 10A to fit compressively against each other. For most structures, constructed in accordance with the Custom Construction System, the torque resistance resulting from the compressive joint is sufficient for assembly purposes. The resultant assemblies having compression joints are then rigidized by triangular or parallelogram structures.

Figure 9:
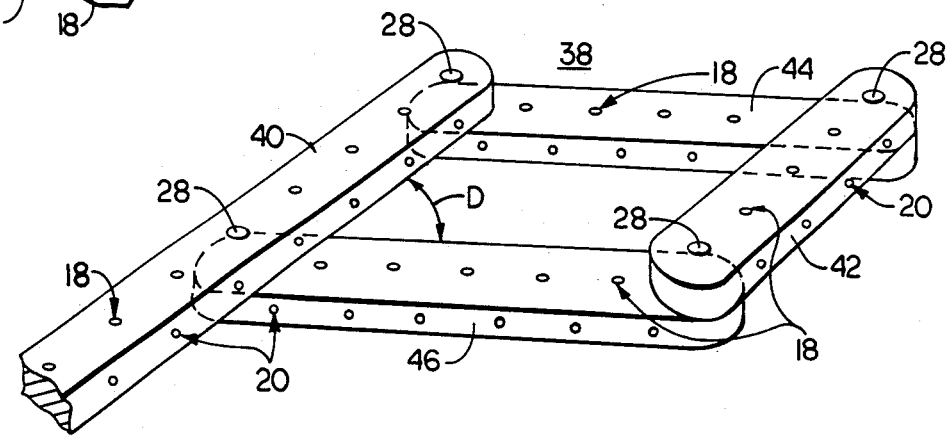
FIG. 9 is a fragmentary perspective view of a parallelogram assembled from structural members illustrated in FIG. 1

As best illustrated in FIG. 9, parallelogram structure 28 is assembled from four structural members 10. Parallelogram 28 consists of structural members 40, 42, 44, and 46. Structural members 40 and 42 are in spaced and parallel relationship and overlay the ends of structural members 44 and 46 that are also in spaced and parallel relationship. Angle D can be acute or obtuse; member 40 could underlie member 44 and 45 as well as member 42. Therefore, parallelogram 38 could be a two or a three level overlapping structure.

Figure 10:
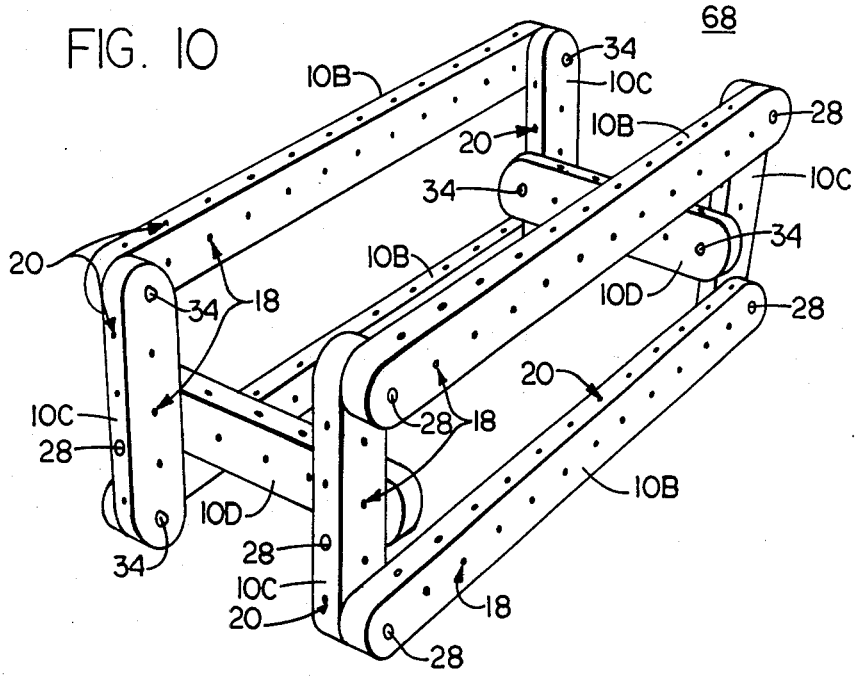
FIG. 10 is a perspective view of a parallelogram structure assembled in accordance with the elements and techniques utilizing the Custom Construction System of the present invention.

As best illustrated in FIG. 10, a further example of a parallelogram structure assembled in accordance with the elements and techniques previously discussed, is illustrated. This structure 68, consisting of a plurality of members 10 forming a plurality of parallelogram 38 can serve as the base for a coffee table or in larger scale as the base for a work bench. Structure 38 could also serve as a model for the underlying structure of a porch or a deck. At this point, it should be pointed out that the variations and applications of the Custom Construction System utilizing various structural members 10 to form pieces of furniture or to accomplish home improvement projects is limited only by the imagination of the user.

Figure 11:
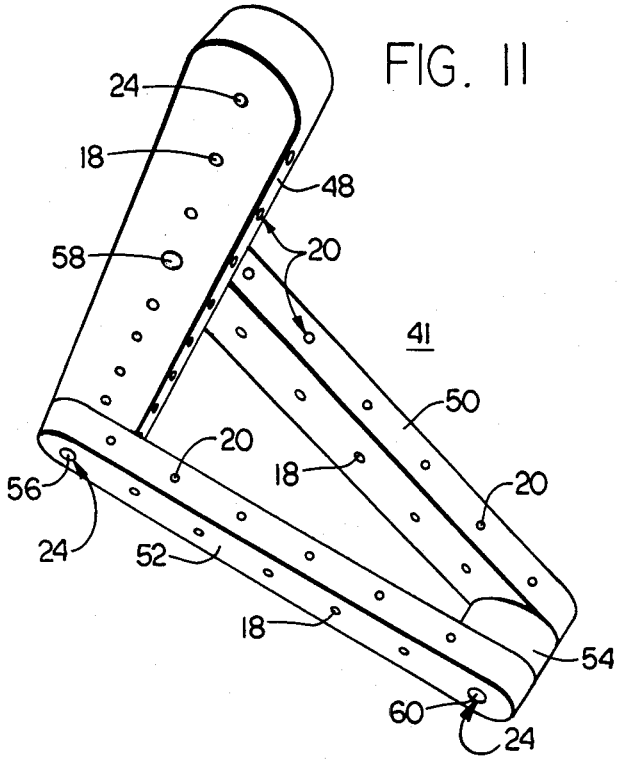
FIG. 11 is a perspective view of a triangular structure consisting of three structural members of FIG. 1 and an equalizer member.

As best illustrated in FIG. 11, means are provided for assembling a triangular structure. In the embodiment illustrated, this consists of equalizer 54 in combination with three structural members 48, 50, 52. In order to assemble structure 41, carriage bolt 56 passes through end side bores 18 in members 48 and 52 to frictionally operatively connect members 48 and 52 in angular relationship with each other. This angular relationship is rigidized or made non-rotating by member 50 performing as a brace. Another carriage bolt 58, identical to the carriage bolt 56, fixedly operatively attaches the upper end of member 50 to the upper portion of and to the far side of member 48. The heretofore free ends of members 50 and 52 are rigidly operatively connected to each other by means of the intervening auspices of equalizer 54 and long carriage bolt 60. Using the above discussed components, triangular structure 41 becomes a three level assembly.

Figure 12:
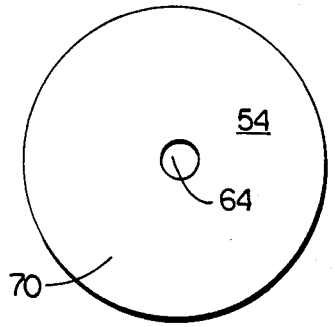
FIG. 12 is a side view of the equalizer member utilized in the Custom Construction System.

As illustrated in FIG. 12, equalizer 54, exhibits the same diameter as the width of member 10. Equalizer 54 incorporates a bore 64 through the center of equalizer face 70 having the same diameter as side surface bores 18 of member 10. Equalizer 54 has the same thickness.

Figure 13:
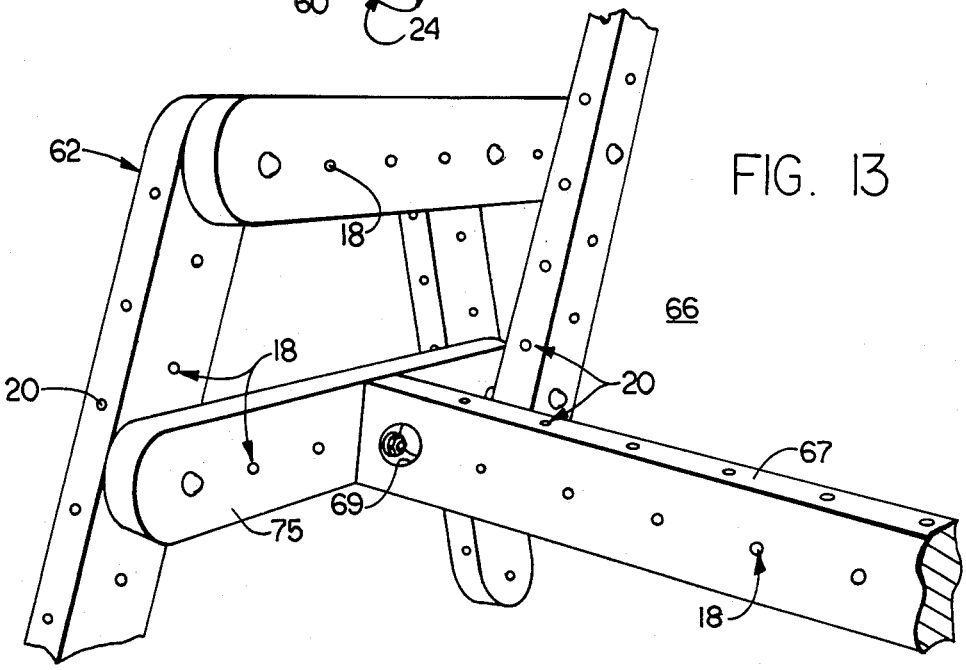
FIG. 13 is a fragmentary prospective view illustrating a combination of the structural members, spacer members, and equalizer members of the Custom Construction System to produce a piece of furniture.

As best illustrated in FIG. 13, the versatility of the parallelogram 38 of FIG. 9 and the triangular structure 41 of FIG. 11 is demonstrated by the combination of these two basic structures into side frame 62. Side frame 62 can be used to construct a chair or bench 66.

Figure 14:
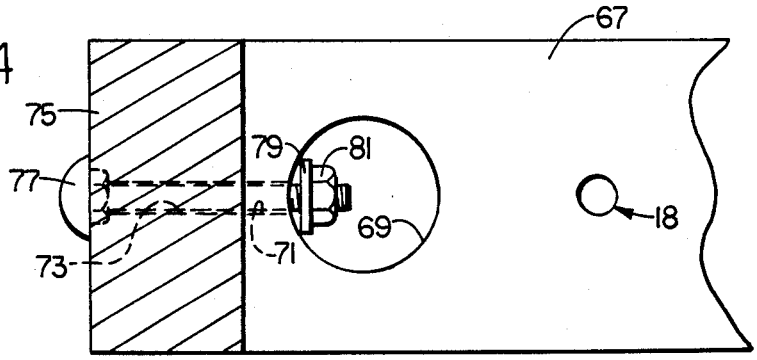
FIG. 14 is a fragmentary side view illustrating the attachment of a spreader member to a structural member.

Means are provide for connecting parallelogram 38 or triangular structural 41 in a spaced and parallel relationship. In the embodiment illustrated, this consists of spreader member 67. Spreader member 67 of the Custom Construction System exhibits the same width, thickness and edge hole pattern as does members 10. As best illustrated in FIG. 14, spreader bore 69 replaces the connecting end bore 24 in the series of side bores 18 of member 10. The extremities of spreader member 67 are rectangular and incorporate a longitudinal bore 71 at the center thereof that communicates between a side bore 73 in member 75 and bore 69 in spreader member 67. Member 75 can be any sized member 10 in the series of structural members 10 utilized with the Custom Construction System or another spreader member 67. As illustrated in FIG. 13, member 75 would be the lower horizontal member 10 of sideframe 62.

As best illustrated in FIG. 14, means are provided for connecting spreader 67 to structural member 75. In the embodiment illustrated, this consists of carriage bolt 77 passing through the side bore 73 and through the longitudinal bore 71 to enter into the confines of bore 69. Bore 69 is large enough to provide for the placement of washer 79 and the threading of nut 81 upon the shaft of bolt 77 with a standard open end wrench (not shown). The length of spreader members 67 are also defined in terms of the number of side bores 18. Spreader members 67 preferably have 3, 5, 7, 13, or 17 holes included in the Custom Construction System along with the previously mentioned structural members 10. As with structural member 10, the distance between bores is 3 inches. It should be understood that spreader member 67 may be longer or shorter than the preferred length.

Figure 15:
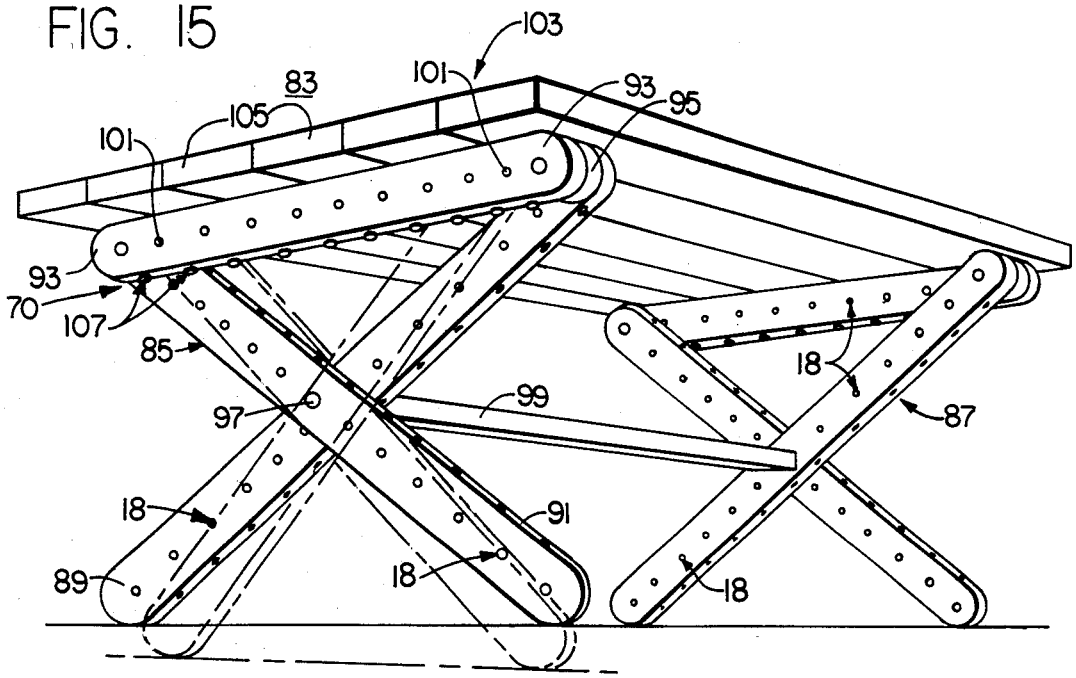
FIG. 15 is a perspective view of a picnic table illustrating the utilization of the Custom Construction System consisting of structural members, spacer members and equalizer members.

As illustrated in FIG. 15, Picnic table 83 resulting from the combination of previously mentioned elements of the Custom Construction System, is shown. Picnic table 83 has supports 85 and 87 being essentially the same triangular structure 41 that was previously discussed with respect to FIG. 11 except that support 85 is a mirror image of support 87. Support 85 consists of member 89, member 91, surface support member 93 and equalizer members 95. It should be pointed out that, except for equalizer 95, all components of support 85 and 87 including surface support member 93 are variations of structural member 10. Carriage bolt 97 passes through side bores 30 at the intersection of members 89 and 91 of support 85 and is fixedly operatively attached into the extremity of spreader member 99. Carriage bolt 97 performs as a pivot for members 89 and 91. It should be noted at this point that carriage bolt 89 is longer than any previously discussed carriage bolts.

As best illustrated in FIG. 15, the upper end of member 91 is fixedly operatively attached to the far side of, and at the left end of, surface support member 93. The upper end of member 89 is in turn fixedly operatively attached to surface support member 93 through the intervening auspices of equalizer member 95. As illustrated by the dot dash line in FIG. 15, if the upper ends of member 89 and 91 are fixedly operatively attached to surface support member 93 by using the second from the end bores 101, then the surface of the table 83 must necessarily be higher. Thus, the versatility of the Custom Construction System, is further illustrated by the resulting adjustable height picnic table.

As best illustrated in FIG. 15, construction of a picnic table utilizing the Custom Construction System is illustrated. Means are provided for operatively attaching boards 105 to supports 85 and 87. In the embodiment illustrated, this consists of surface support members 93. Surface support members 93 of supports 85 and 87 are fixedly operatively attached to board 105 by lag bolts 107. Lag bolts 107 pass upwardly through edge bores 20 in surface support member 93 and threadably mount into the bottom surface of plurality of boards 105. Since bores for receiving lag bolts 107 in plurality of boards 105 are not through bores, they must be marked and drilled at assembly. Predrilled plurality of boards 105 can also be provided with the Custom Construction System so that it is acceptable for the round heads of the commonly used carriage bolts to protrude from table top 103.

Figure 16:
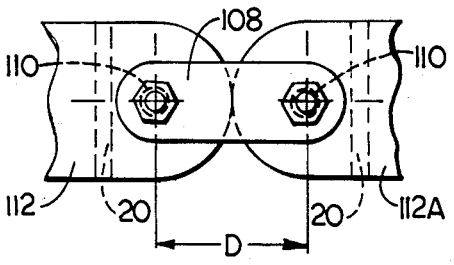
FIG. 16 is a fragmentary side view of the strap used to connect two structural membes utilized in the Custom Construction System.
Figure 18:
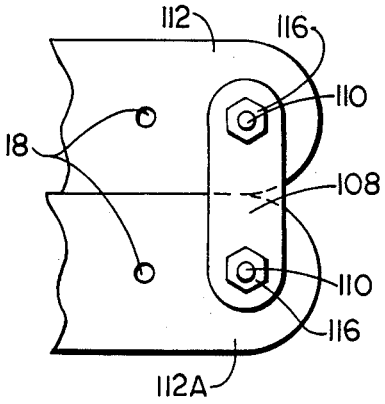
FIG. 18 is a fragmentary partial side view of the strap utilized to connect two structural members of FIGS. 16 and 17 rotated 180°.
Figure 17:
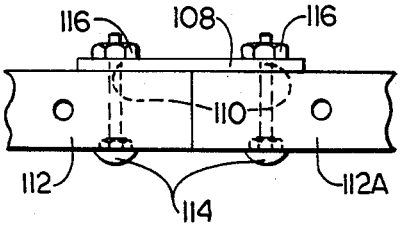
FIG. 17 is a fragmentary top or bottom view of the strap utilized to connect two structural members.
Figure 19:
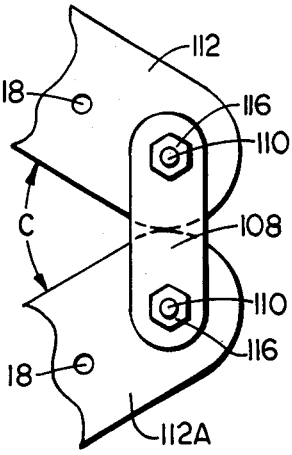
FIG. 19 is a fragmentary partial side view of the strap utilized to connect two structural members of FIG. 1 rotated at approximately 45°.
Figure 20:
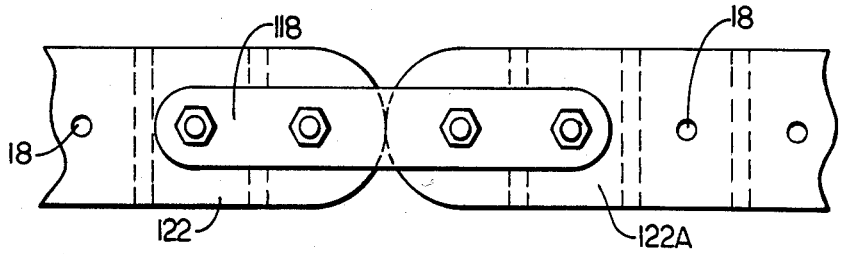
FIG. 20 is a fragmentary partial side view of an elongated strap of the type illustrated in FIGS. 16 thru 19 for joining two structural members.

As best illustrated in FIGS. 16 and 17, further flexability of the Custom Constructon System is illustrated by the inclusion of means for operatively attaching two structural members at end bore 24. In the embodiment illustrated, this consists of strap 108. Strap 108 is constructed from thin gauge sheet metal and is provided with holes 110 at each end thereof. Distance "D" between the holes 110 is equal to the width of the member 112 and 112A with which it cooperates. Carriage bolts 114 pass through the end bores 24 in Members 112 and 112A, and through the bores 110 in strap 108. Nuts 116 threadably mounted upon the ends of carriage bolts 114 are used for operatively attaching member 112 and 112A in planer relationship with each other. Members 112 and 112A can be held end-to-end as illustrated in FIG. 16 or side by side as illustrated in FIG. 18, or in an angular relationship, as illustrated in FIG. 19. Again, the angle "C" can be either acute or obtuse. It should be noted that unless the use of strap 108 is accompanied by other structural pieces in a given assembly it does not necessarily yield a rigid non-rotatable joint.

Figure 21:
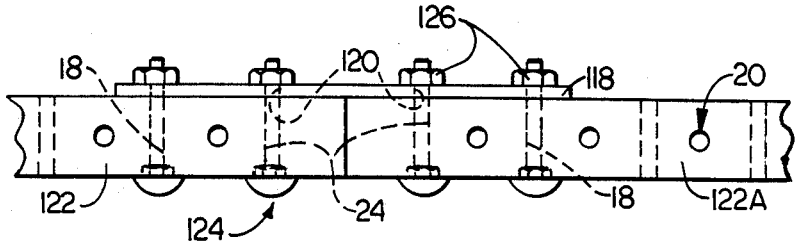
FIG. 21 is a partial fragmentary top view of the elongated strap of FIG. 20.

Further flexibility is added to the Custom Construction System with the addition of means for providing a rigidly fixed non-rotating joint for two end abutting structural members. In the embodiment illustrated, this consists of elongated strap 118. Elongated strap 118 is of the same construction as strap 108, previously discussed, except for its length and number of bores. Elongated strap 118 incorporates a set of four bores 120 that cooperate with the last two bores of the side holes 18 in two end abutting members 122 and 122A. A set of four bolts 124 passes upwardly (with respect to FIG. 21) through the end pairs of bores of the side bores 18 in the members 122 and 122A, then through the bores in elongated strap 118 to threadedly accept nuts 126. Tightening nuts 126 fixedly opeatively attaches member 122 and 122A in a fixed lengthwise relationship with each other. When one considers stacking of bunk beds, shelving, or the like, the utility of this attachment method is readily apparent.

Figure 22:
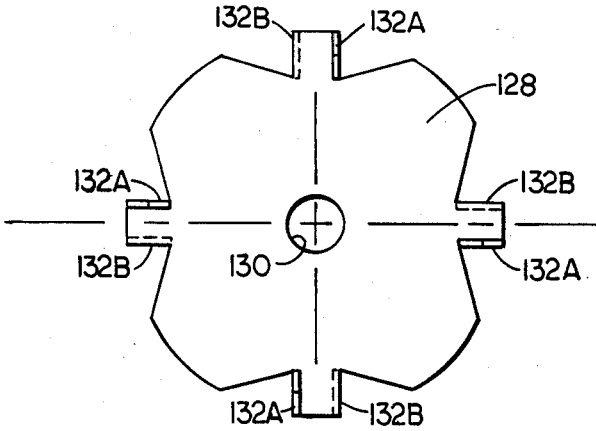
FIG. 22 is a side view of a gang nail washer which is utilized to produce a rigid non-rotating joint between structural members.
Figure 23:
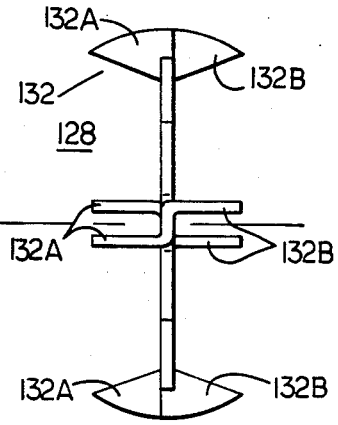
FIG. 23 is a top or bottom view of the gang nail washer of FIG. 22.

As was previously described with respect to FIG. 6, the end overlap joint 26 of the Custom Construction System's member 10, exhibits a moderate amount of torque resistance. As best illusrated by FIGS. 22 and 23, means are provided for producing a rigid joint between two structural members 10. In the embodiment illustrated, this consists of gang nail washer 128. Gang nail washer 128 is constructed from a circular piece of sheet metal. Hole 130 is provided through the center of the pieces of sheet metal, to permit passage of carriage bolts used with the Custom Construction System. Triangular tabs 132 are formed at right angles to the face of, and about the circumference of gang nail washer 128 to perform as nails. The base of each triangular tab 132 is largely disposed along a radial line from the center of gang nail washer 128. This utilization of the flat side of the triangular tabs 132 as a bearing area to resist torque when washer 128 is pressed or driven into a piece of wood. Four of the triangular tabs 132A are formed in one direction while the remaining four tabs 132B are formed at approximately a 180° angle to the first tabs.

Figure 24:
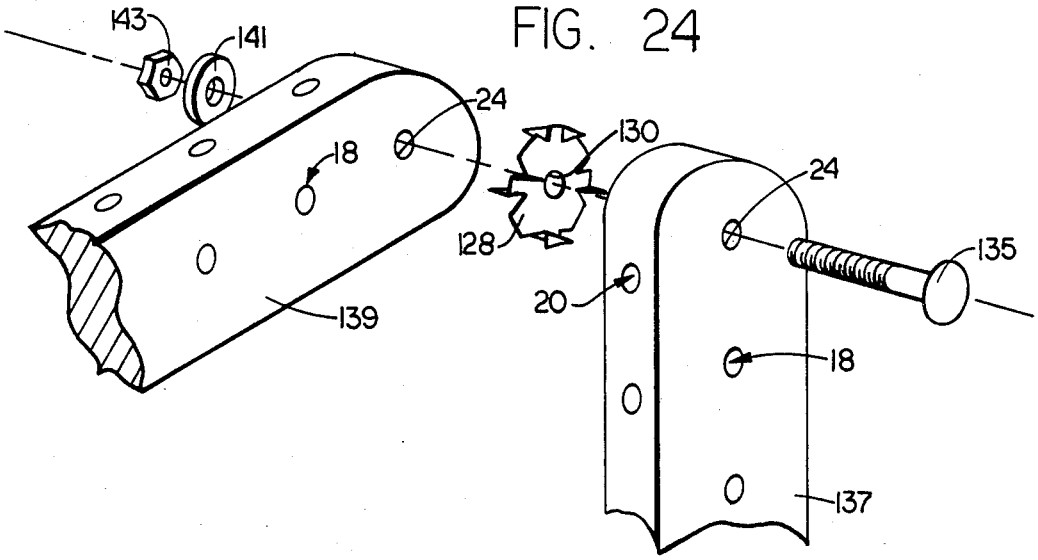
FIG. 24 is a fragmentary perspective view illustrating the utilization of the gang nail washer of FIGS. 22 and 23 to connect two structural members.

As best illustrated by FIG. 24, gang nail washer 128 is used to produce a rigid overlapping joint. Long bolt 135 is inserted through one of side bores 18 in member 137, through hole 130 of gang nail washer 128, through any one of bores 18 in member 139, and through washer 141 to threadably receive nut 143. Tightening nut 143 draws member 137 toward member 139. As the members 137 and 139 are drawn together, triangular tabs 132 of gang nail washer 128 are pressed into the surface of each of members 137 and 139. Gang nail washer 128 remains stable during the pressing operation since there are two sets of four tabs 132A and 132B. Tabs 132A and 132B are set close to each other on the circumference of washer 128 to minimize flexure and deformation due to compression loads. After completing the pressing operation, since long bolt 135 is too long, it is removed and replaced by another bolt of appropriate length.

Figure 26:
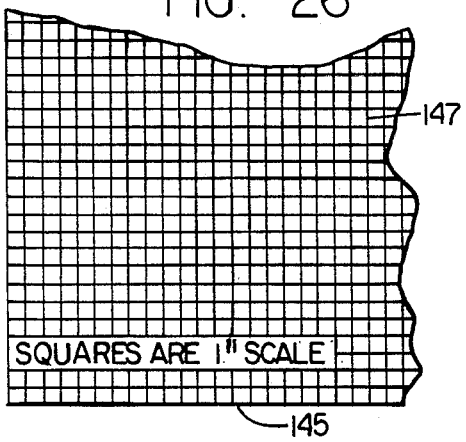
FIG. 26 is a partial front view of a planning sheet for use with Custom Construction System.

As best illustrated in FIG. 26, means are provided for allowing the home "do-it-yourself" carpenter to initially completely design his project on paper prior to beginning actual works. In the embodiment illustrated this consists of planning sheet 145. Planning sheet 145, has square grids 147 drawn in one inch scale, which facilitates the planning and layout of custom structures that helps the System user predict exactly which pieces and the number of pieces required.

The full impact of the Custom Construction System is that a user with limited time or skill can plan or purchase ready made pieces, and then assemble even large and complicated custom constructions which do not have sharp corners or exposed bolts utilizing only one tool, a standard open end wrench.

Figure 27:
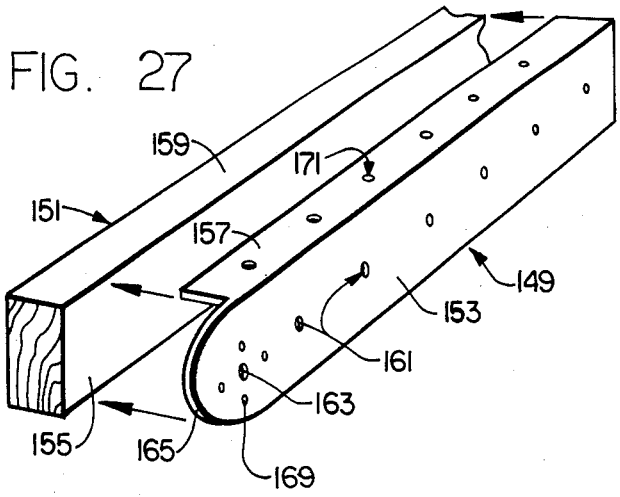
FIG. 27 is a perspective partial view illustrating the utilization of a template to construct a structural or spreader member from a work piece.
Figure 28:
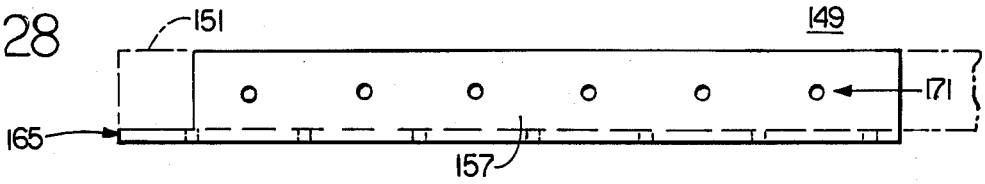
FIG. 28 is a top view of the template of FIG. 27.
Figure 29:
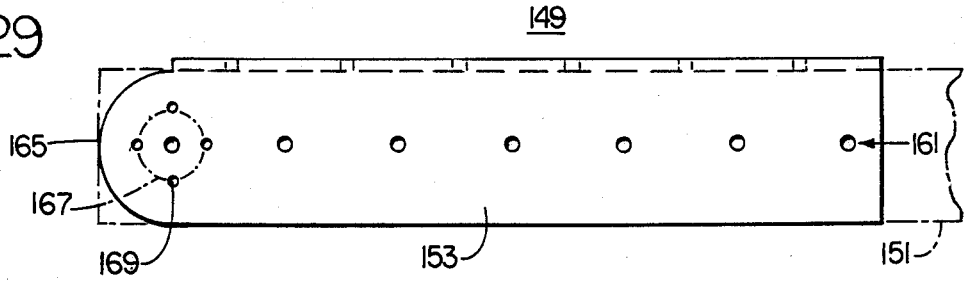
FIG. 29 is a side view of the template of FIG. 27.

As best illustrated in FIGS. 27–29, means are provided for converting standard workpieces to the various structural members and spreader members utilizied with the Custom Construction System. In the embodiment illustrated, this consists of an apparatus for constructing a structural member or template 149. Template 149 is constructed of sheet metal and is formed into two flanges at a 90° angle so as to fit flush with the two sides of workpiece 151. As previously discussed, workpiece 151 is preferrably a standard 2×4 piece of lumber.

With specific reference to FIGS. 27–29, the inside measurement of the height of vertical flange 153 of template 149 is the same as side 155 of workpiece 151. Vertical flange 153 of template 149 incorporates a plurality of apertures or bores 161 that are equally spaced along the centerline of the inside surface of vertical flange 153. First bore 163 of plurality of bores 161 lies at the center of end radius 165 of vertical flange 153. Equally spaced about bolt circle 167, having bore 163 as its center, is a set of four bores or holes 169.

Similarly, the horizontally disposed flange 157 incorporates a plurality of appertures or bores 171 that are equally spaced about the center of the inside surface thereof. There are two less bores in the plurality of bores 171 than there are in plurality of bores 161. Bores 171 are longitudinally placed alternately with respect to plurality of bores 161. Plurality of bores 161 and 171 have the same spacing as do the bores in member 10 of FIG. 1. All the bores in template 149 are "centers" that is, small diameter bores used as guides for marking workpiece 151.

During operation of the template 149 to convert workpiece 151, a more skilled user with sufficient tools can quickly mark all bore centers and end radius 165 for cutting and drilling structural members and spreader members utilized with the Custom Construction System.

Since template 149 can be shifted along a workpiece to form longer structural members as well as reversing it for marking the opposite end, it is of universal usage. Set of four holes 169 in template 149 serves as centers for marking nail positions to ridigize an overlapping joint without the use of gang nail washer 128. Template 149 is all that a more skilled user would need to convert a wide variety of work pieces into the various members utilized with the Custom Construction System.

Figure 25:
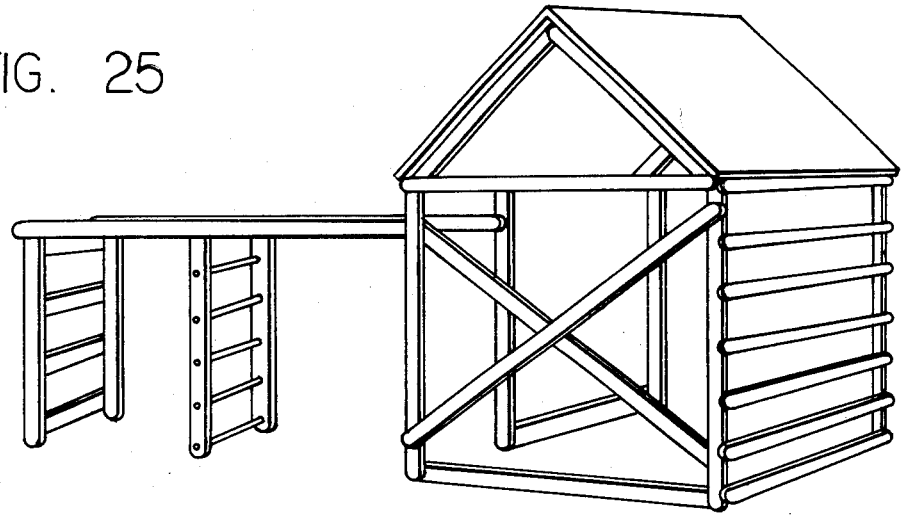
FIG. 25 is a perspective view of a complex construction assembled, utilizing the Custom Construction System.

In summary, the Custom Construction System consists of the following a series of structural members, a series of spreader members, an equalizer member, a two hole strap, a four hole strap, a gang nail washer, plain washers, lock washers, plain nuts, wing nuts, soft bolt caps, a series of different length carriage bolts and for the more advanced home "do-it-yourself carpenter of, a templet. The systems' versatility, which is illustrated in FIG. 25, permits the assembly of furniture, decks, toys, and numerous other structures.

Thus, it is apparent that there has been provided, in accordance with the present invention, a Custom Construction System that fully satisfies the objects, aims and advantages setforth above. While the invention has been described in conjunction with a specific embodiment thereof, it is evident that many alterations, modifications and variations will be apparent to those skilled in the art in light of the foregoing description. Accordingly, it is intended to embrace all such alternatives, modifications and variations as fall within the spirit and scope of the appended claims.

What is claimed is:

1. A custom construction system adapted to eliminate sharp or jagged edges, compromising:

a first straight structural member having spaced-apart first and second ends;

a second straight structural member having spaced-apart third and fourth ends;

each said structural member having a pair of opposed flat sides each of width x and a pair of opposed edges therebetween, said sides and said edges of each said structural member extending between said ends thereof to define a generally rectangular cross-section between said ends;

said first structural member further including a first bore means in said first end for receiving a securement device therethrough, said first bore means extending between said sides and spaced a distance approximately x/2 from each said edge of said first structural member;

said second structural member further including second bore means in said third end for receiving a securement device therethrough, said second bore means extending between said sides and spaced a distance approximately x/2 from each said edge of said second structural member;

said first end and said third end each being adapted to define a semicircular arc having a radius approximately x/2 centered about said first bore means and said second bore means, respectively, when said structural member is viewed from a said side thereof;

said first end adapted to be joined to said third end such that a portion of one said side of said first structural member overlaps a portion of one said side of said second structural member and such that said first bore means is coaxially aligned with second bore means whereby there will be substantially no portion of said first end projecting beyond said third end when viewed from a non-overlapping said side of one of said structural members thereby to eliminate sharp or jagged edges.

2. A custom construction system adapted to eliminate sharp or jagged edges, compromising:

a first straight structural member having spaced-apart first and second ends;

a second straight structural member having spaced-apart third and fourth ends;

each said structural member having a pair of opposed flat sides each of width x and a pair of opposed edges therebetween, said sides and said edges of each said structural member extending between said ends thereof to define a generally rectangular cross-section between said ends;

said first structural member further including a first bore means in said first end for receiving a securement device therethrough, said first bore means extending between said sides and spaced a distance appoximately x/2 from each said edge of said first structural member;

said second structural member further including second bore means for receiving a securement device therethrough, said second bore means extending between said sides and spaced a distance approximately x/2 from each said edge of said second structural member;

said first end being adapted to define a semicircular arc having a radius approximately x/2 centered about said first bore means when said first structural member is viewed from a said side thereof;

said first end of said member adapted to be joined to said second member such that a portion of one said side of said first structural member ovelaps a portion of one said side of said second structural member and such that said first bore means is coaxially aligned with said second bore means whereby there will be no portion of said first end projecting beyond said side of second structural member when viewed from a non-overlapping said side of one of said structural members thereby to eliminate sharp or jagged edges.

3. A custom construction system adapted to rest level, compromising:

a first straight structural member having spaced-apart first and second ends;

a second straight structural member having spaced-apart third and fourth ends;

each said structural member having a pair of opposed flat sides each of width x and a pair of opposed edges therebetween, said sides and said edges of each said structural member extending between said ends thereof to define a generally rectangular cross-section between said ends;

said first structural member further including a first bore means for receiving a securement device therethrough, said first bore means extending between said sides and spaced a distance approximately x/2 from each said edge of said first structural members;

said second structural member further including a second bore means for receiving a securement device therethrough, said second bore means extending between said sides and spaced a distance approximately x/2 from each said edge of said second structural member;

said first end being adapted to define a semicircular arc having a radius approximately x/2 centered about a first point on said side of said first structural member spaced a distance approximately x/2 from each said edge thereof when viewed from a said side of said first structural member;

said third end being adapted to define a semicircular arc having a radius approximately x/2 centered about a second point on a said side of said second structural member spaced a distance approximately x/2 from each said edge thereof when viewed from a said side of said second structural member;

said first member adapted to be joined to said second member such that said bore means are coaxially aligned and a portion of one said side of said first member overlaps a portion of one said side of said second member to define an angle between (i) a portion of said first structural member defined between said first end and said first bore means and (ii) a portion of said second structural members defined between said third end and said second bore means, said angle being between 0° and 180°, whereby, between 0° and 180°, said first end and said third end will rest evenly on a predetermined plane irrespective of said angle.

4. A custom construction system adapted to rest level, compromising:

a first straight structural member having spaced-apart first and second ends;

a second straight structural member having spaced-apart third and fourth ends;

each said structural member having a pair of opposed flat sides each of width x and a pair of opposed edges therebetween, said sides and said edges of each said structural member extending between said ends thereof to define a generally rectangular cross-section between said ends;

said first end and said second end each being adapted to define a semicircular arc having a radius approximately x/2 centered about a first point and a second point, respectively, on a said side of said first structural member, each said point being spaced a distance approximately x/2 from each said edge of said first structural member when viewed from a said side of sair first structural member;

said third end and said fourth end each being adapted to define a semicircular arc having a radius approximately x/2 centered about a third point and a fourth point, respectively, on a said side of said second structural member, each said third and fourth point being spaced a distance approximately x/2 from each said edge of said second structural member when viewed from as said side of said second structural member;

said first structural member further including a first bore means for receiving a securement device therethrough, said first bore means situated between said first and second points, extending between said sides and spaced a distance approximately x/2 from each said edge of said first structural member;

said second structural member further including a second bore means for receiving a securement device therethrough, said second bore means situated between said third and fourth points, extending between said sides and spaced a distance approximately x/2 from each said edge of said second structural member;

said first member adapted to be joined to said second member such that said bore means are coaxially aligned and a portion of one said side of said first member overlaps a portion of one said side of said second member to define an angle between (i) a portion of said first structural member defined between said first end and said first bore means and (ii) a portion of said second structural member defined between said third end and said second bore means, said angle being between 0° and 180°, whereby, between 0° and 180°, a first line defined across, in contact with and past, but not extending into, said first and third ends will remain parallel to a second line defined across, in contact with and past, but not extending into, said second and fourth ends, irrespective of said angle.

* * * * *

UNITED STATES PATENT AND TRADEMARK OFFICE

CERTIFICATE OF CORRECTION

PATENT NO. : 4,620,747

DATED : November 4, 1986

INVENTOR(S) : Patrick Lemmon

It is certified that error appears in the above-identified patent and that said Letters Patent is hereby corrected as shown below:

Col. 3, line 54, "membes" should be --members--.

Col. 5, line 40, "hich" should be --which--.

Col. 5, line 49, "28" should be --38--.

Col. 6, line 31, "provide" should be --provided--.

Col. 7, line 57, "planer" should be --planar--.

Col. 8, line 11, "opeatively" should be --operatively--.

Col. 12, line 22, "sair" should be --said--.

Col. 12, line 30, "as" should be --a--.

Col. 10, line 3, change "compromising" to --comprising--.

Col. 10, line 44, change "compromising" to --comprising--.

Col. 11, line 15, change "compromising" to --comprising--.

UNITED STATES PATENT AND TRADEMARK OFFICE

CERTIFICATE OF CORRECTION

PATENT NO. : 4,620,747

DATED : November 4, 1986

INVENTOR(S) : Patrick Lemmon

It is certified that error appears in the above-identified patent and that said Letters Patent is hereby corrected as shown below:

Col. 12, line 4, change "compromising" to -- comprising --.

Signed and Sealed this

Twenty-eighth Day of April, 1987

*Attest:*

DONALD J. QUIGG

*Attesting Officer*

*Commissioner of Patents and Trademarks*